US011615717B2

(12) United States Patent
Coelho

(10) Patent No.: US 11,615,717 B2
(45) Date of Patent: Mar. 28, 2023

(54) CUSTOMIZABLE PACKAGING METHODS AND APPARATUS

(71) Applicant: Apurimac Co., Limited, Kowloon (CN)

(72) Inventor: Alexx Coelho, Oakville (CA)

(73) Assignee: Apurimac Co., Limited, Hong Kong (CN)

( * ) Notice: Subject to any disclaimer, the term of this patent is extended or adjusted under 35 U.S.C. 154(b) by 698 days.

(21) Appl. No.: 16/591,268

(22) Filed: Oct. 2, 2019

(65) Prior Publication Data

US 2020/0105164 A1 Apr. 2, 2020

Related U.S. Application Data

(60) Provisional application No. 62/740,206, filed on Oct. 2, 2018.

(51) Int. Cl.

| | |
|---|---|
| ***G09F 23/00*** | (2006.01) |
| ***G09F 3/02*** | (2006.01) |
| ***B65D 33/00*** | (2006.01) |
| ***B65C 1/02*** | (2006.01) |

(52) U.S. Cl.

CPC ..... *G09F 3/02* (2013.01); *B65C 1/02* (2013.01); *B65D 33/004* (2013.01); *G09F 23/00* (2013.01); *G09F 2003/0213* (2013.01); *G09F 2023/0025* (2013.01)

(58) Field of Classification Search

CPC .... G09F 3/02; G09F 23/00; G09F 2003/0213; G09F 2023/0025; G09F 23/06; B65C 1/02; B65D 33/004; A63F 3/0665; A63F 3/068; B42D 25/27

See application file for complete search history.

(56) References Cited

U.S. PATENT DOCUMENTS

| | | | | |
|---|---|---|---|---|
| 5,154,448 | A * | 10/1992 | Griffin | G09F 3/0292 283/102 |
| 7,243,795 | B2 * | 7/2007 | Gold | B65D 25/34 40/310 |
| 9,092,999 | B1 * | 7/2015 | Harruff | G09F 3/10 |
| 2002/0190115 | A1 * | 12/2002 | Schuren | B65D 3/06 206/459.5 |
| 2004/0129712 | A1 * | 7/2004 | Egan | G09F 3/10 220/592.16 |
| 2006/0249950 | A1 * | 11/2006 | Kenney | B42D 25/29 283/81 |
| 2009/0172990 | A1 * | 7/2009 | Corey | G09F 3/02 40/675 |
| 2009/0194449 | A1 * | 8/2009 | Wu | B65D 23/14 206/459.5 |

* cited by examiner

*Primary Examiner* — Cassandra Davis

(74) *Attorney, Agent, or Firm* — Hall Estill Law Firm

(57) ABSTRACT

Embodiments of the invention are directed to a scratch away labeling system for a package, for instance a gift bag. In an embodiment, the scratch away system integrates into a package by replacing an aperture cut into a package with a single use, scratch away surface, and then covering the surface with a peel-away film to preserve the surface prior to intended use.

19 Claims, 10 Drawing Sheets

CUSTOMIZABLE PACKAGING METHODS AND APPARATUS

CROSS-REFERENCE TO RELATED APPLICATIONS

The present application claims priority under 35 U.S.C. 119(e) of U.S. Provisional Application Ser. No. 62/740,206, filed Oct. 2, 2018, which is hereby expressly incorporated herein by reference in its entirety.

STATEMENT REGARDING FEDERALLY SPONSORED RESEARCH OR DEVELOPMENT

Not applicable.

FIELD OF THE INVENTION

The present disclosure generally relates to customizable packaging, and more particularly, not by way of limitation, to improved gift bags and envelopes. Such packaging includes a writable surface that allows for the inclusion of customized messaging to create a unique label for the packaging.

BACKGROUND OF THE INVENTION

Packaging generally contains a mechanism for messaging viewable on the outer surface. The information contained on packaging often includes some reference to the intended recipient of the contents of the packaging. Such information exists in association with a variety of types of packaging, including envelopes and bags.

A variety of issues arise from the mechanisms utilized in association with the creation and affixation of the messaging onto packaging. In many instances, an externally created messaging label is affixed in some manner to the packaging. Often, such externally created messaging label is not customizable after it is created. In certain contexts, the messaging label is attached to a package with adhesive glue, though a challenge arises for uniform or neat placement on the exterior surface of the package. The placement of a label with adhesive often leads to an unattractive appearance due to lack of uniformity with other packages or lack of alignment with the contours or edges of the packaging. A need therefore remains for an improved means to place a message on a package in an aligned, neat, and uniform manner.

In many contexts, messages are simply written on the package itself. For instance, a package such as a cardboard box parcel or a mailing envelope is simply addressed by writing an address onto the exterior surface of the package with a pen or marker. However, the ink may subsequently smear or rub off during the process of delivery. The material of the package may not allow for adequate adherence of the ink to the package. Further, the standard attachment of address and other information may create a subpar image associated with the package, making a package with a handwritten note on the outside unsuitable for transfer as a gift, for example. Therefore, a need remains for a package to have a customizable message on the exterior in an image presentation adequate for transfer or delivery as a gift.

Some packages have bounded writing areas intended to facilitate an improved means for incorporating a message onto the external surface of the package material. For instance, some boxes have a bounded address area. Some envelopes, likewise, have a bounded area underscored by lines for placement of a gift message. However, these areas are not protected in any fashion from unintended marking prior to the user's receipt. Therefore, a third party can mark within the bounded areas prior to the transferor of the packaging having the ability to write a message intended for delivery associated with the packaging in such bounded areas. An unmet need remains to protect an intended writing area with a shield surface to prevent unintended marking of the area prior to the delivery of the package.

Relatedly, most packaging lacks guidelines for specialized or customized writing utensils well-suited to mark the packaging to avoid smearing and to allow for clear display of the intended messaging. For instance, use of a marker on a glossy white box often results in smearing of the ink. A need therefore remains for a mechanism of affixing a message onto packaging with a customized and/or standardized writing instrument tailored to the exterior surface of the packaging.

The process of packaging, in particular in association with enclosures like gift backs designed for rapid enclosure of gift contents, often is perceived as a mundane activity. Gift bags have become the easy way to wrap a gift. Recipients often re-use gift bags for the next gift they give. Thereby, gift bags have no personalization or panache. A recipient of a gift bag has little ability to determine whether any effort whatsoever has been made to tailor a gift to the recipient, or whether the gift bag received was simply repurposed from another gift. A need therefore remains to preserve the efficient packaging advantages associated with simple enclosure packaging such as gift bags, but to allow for the facilitation of customization to satisfy recipient's desire to know whether the delivery of the package was done with any modicum of customization of the gift to the recipient.

DETAILED DESCRIPTION OF THE INVENTION

Figure 1:
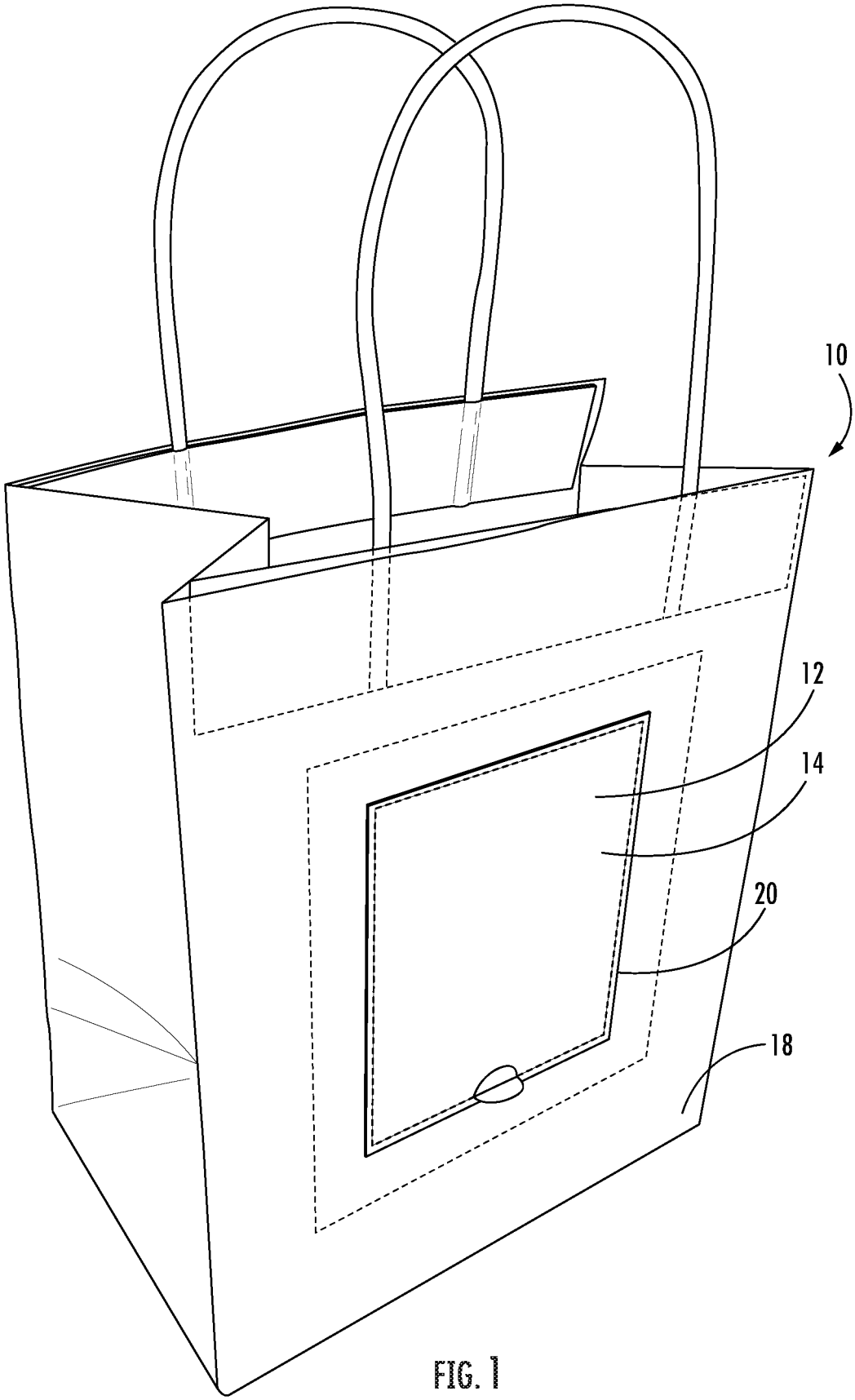
FIG. 1 is a perspective view of one embodiment of a label assembly constructed is accordance with the present disclosure, the label assembly attached to an outside of a gift bag.

Before explaining at least one embodiment of the inventive concept disclosed herein in detail, it is to be understood that the inventive concept is not limited in its application to the details of construction, experiments, exemplary data, and/or the arrangement of the components set forth in the following description, or illustrated in the drawings. The presently disclosed and claimed inventive concept is capable of other embodiments or of being practiced or carried out in various ways. Also, it is to be understood that the phraseology and terminology employed herein is for purpose of description only and should not be regarded as limiting in any way.

In the following detailed description of embodiments of the inventive concept, numerous specific details are set forth in order to provide a more thorough understanding of the inventive concept. However, it will be apparent to one of ordinary skill in the art that the inventive concept within the disclosure may be practiced without these specific details. In other instances, well-known features have not been described in detail to avoid unnecessarily complicating the instant disclosure.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

One embodiment of the invention is described as a customizable field for message presentation incorporated into a package to facilitate the transfer of goods. In particular, embodiments of the invention provide a solution to customizing a package with a writable surface to provide a specific label for the package tailored to the user's whims. In an embodiment, the package comprises a gift bag. In an alternative embodiment, the package comprises an envelope.

Figure 2:
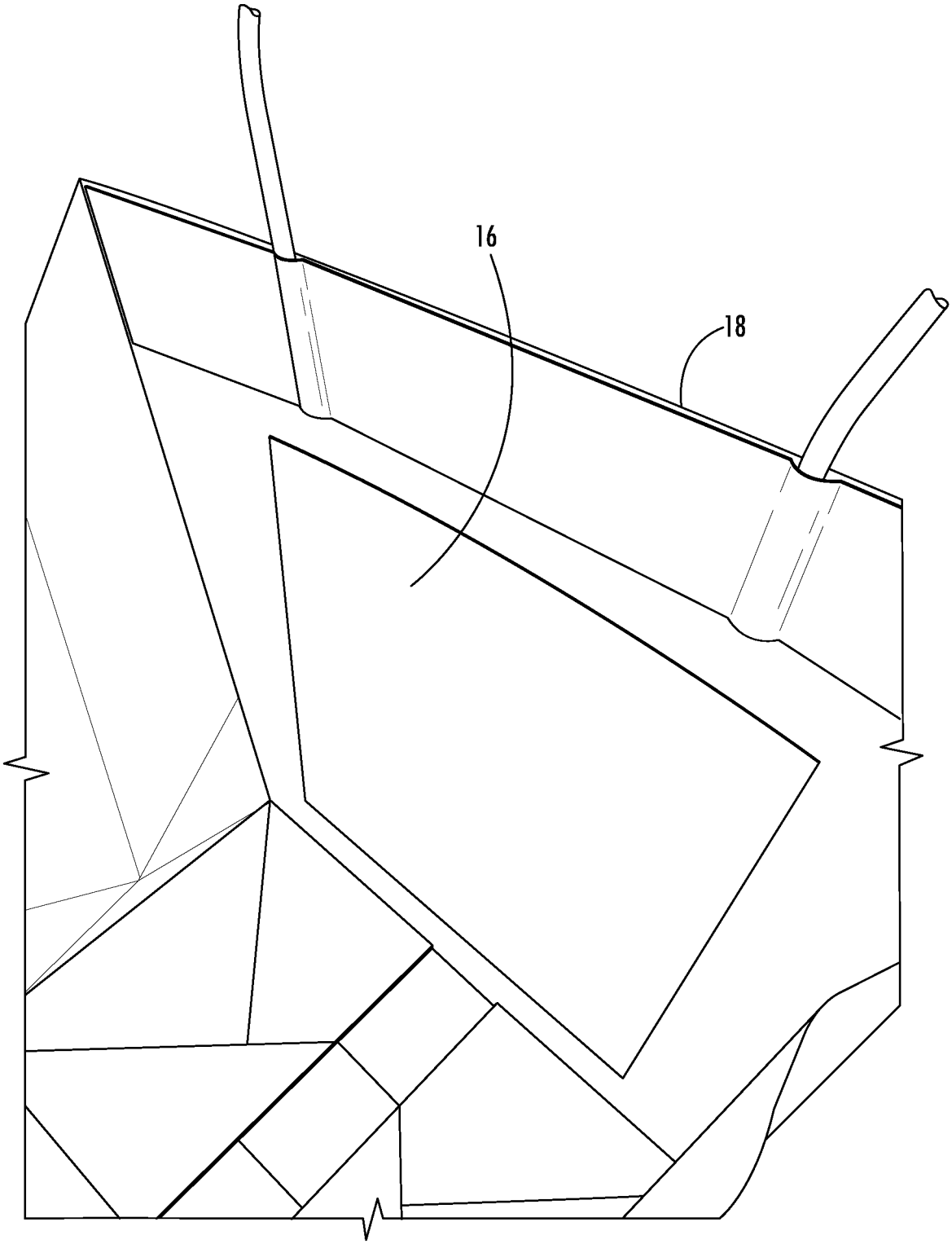
FIG. 2 is a top, back view of the label assembly inside the gift bag of FIG. 1.
Figure 3:
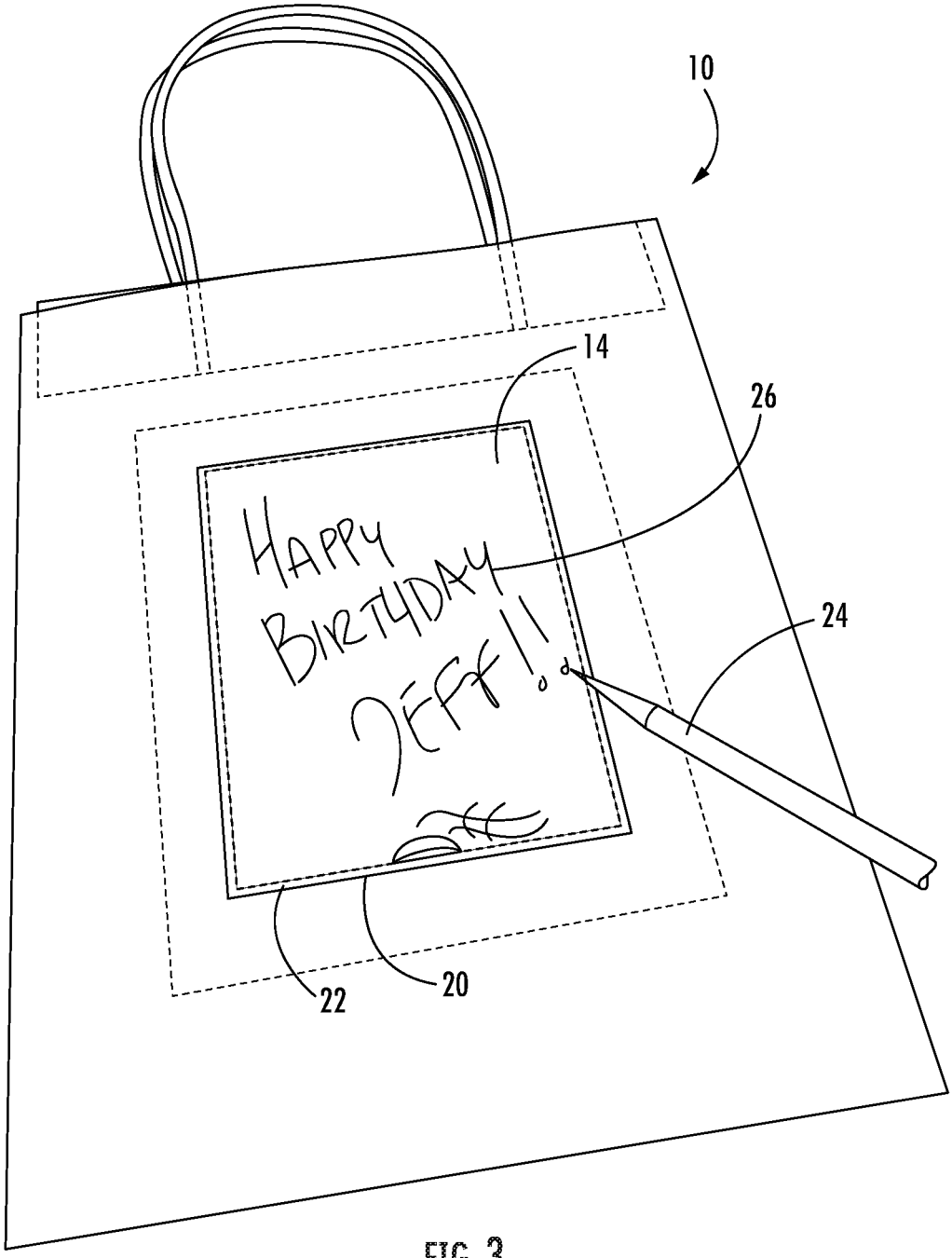
FIG. 3 is a front view of the gift bag of FIG. 1, a portion of the label assembly having a customized message.
Figure 4A:
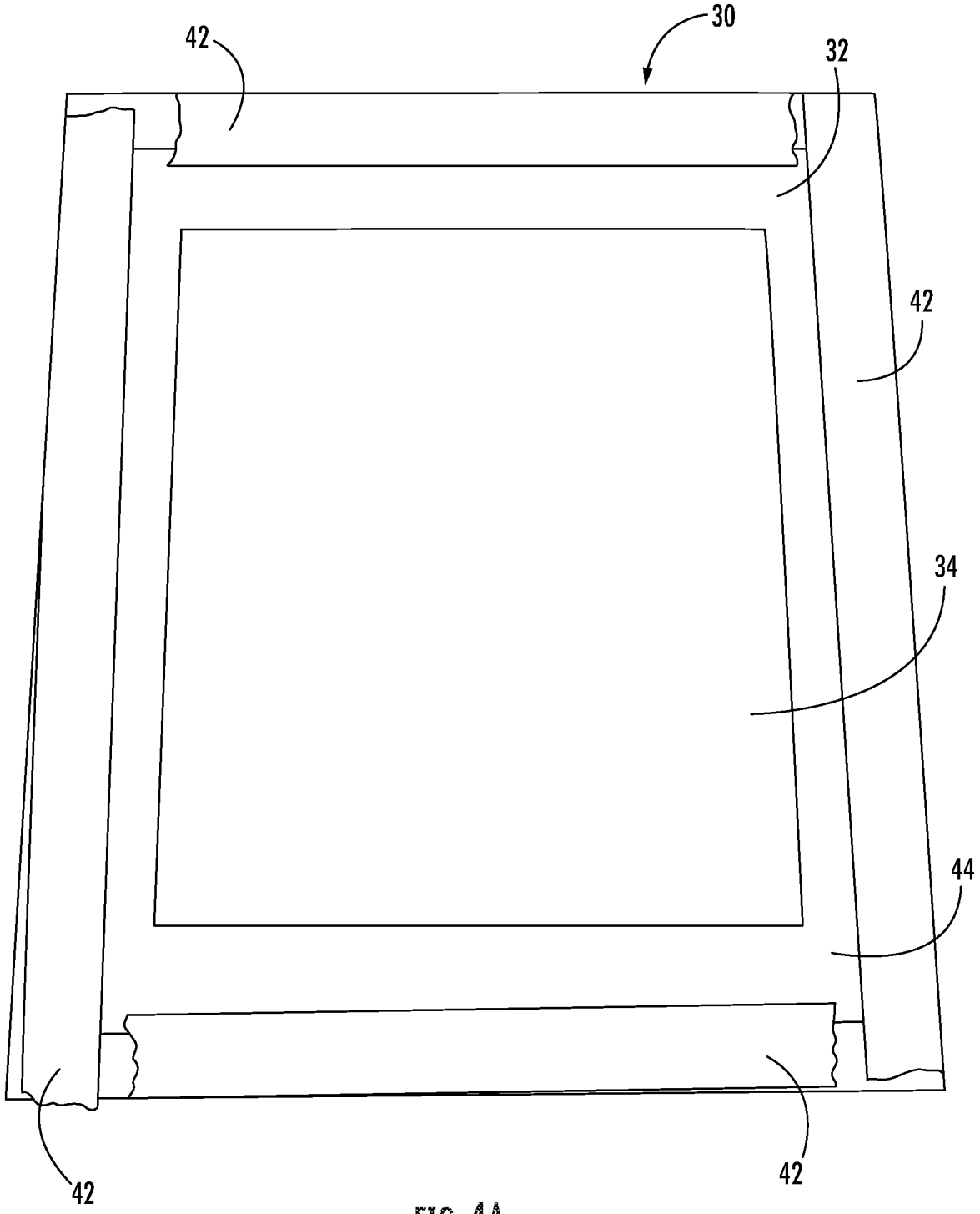
FIG. 4*a* is a front view of another embodiment of a label assembly.
Figure 4B:
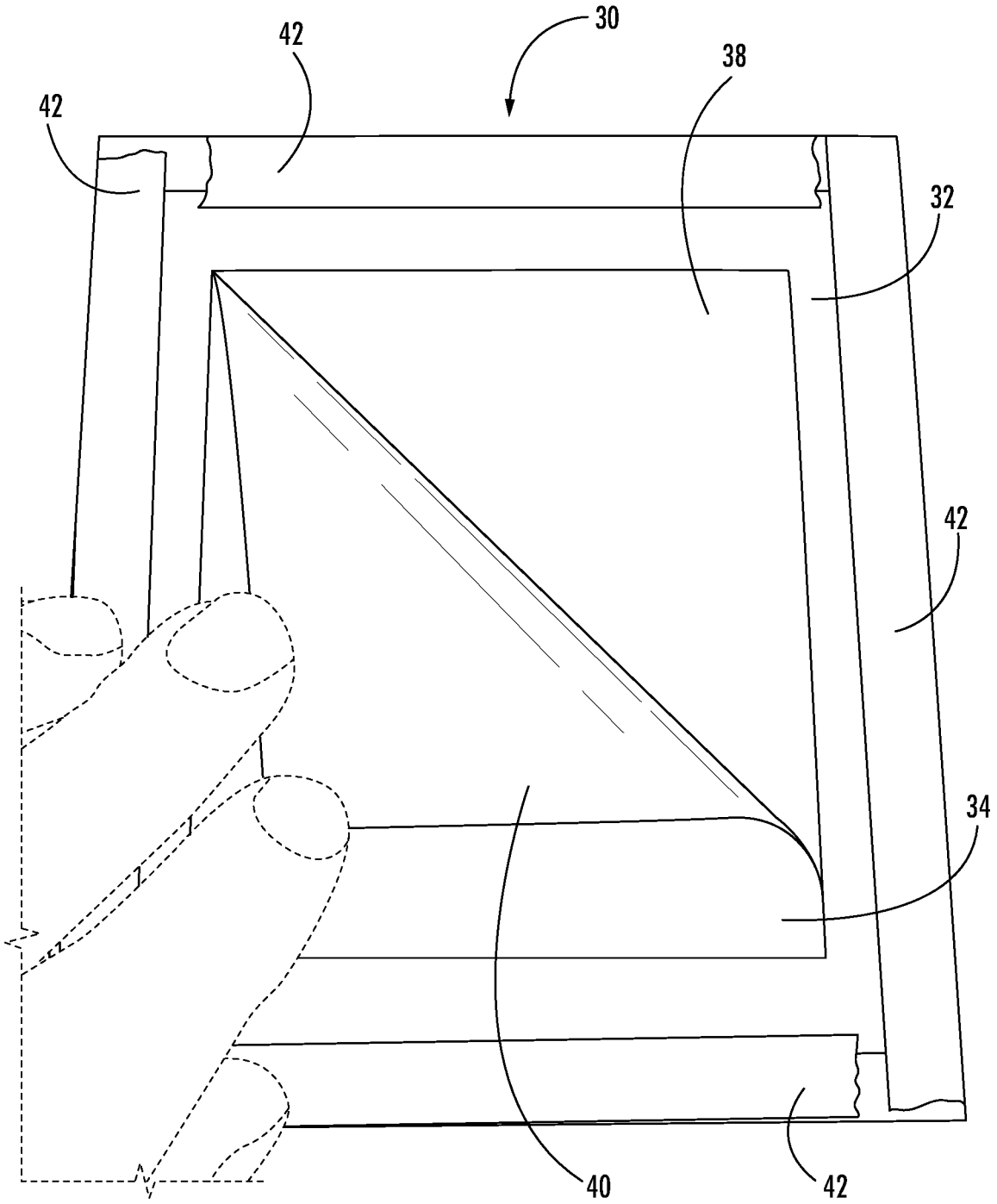
FIG. 4*b* is a front view of the label assembly of FIG. 4*a* having a portion of the label assembly partially removable.
Figure 5:
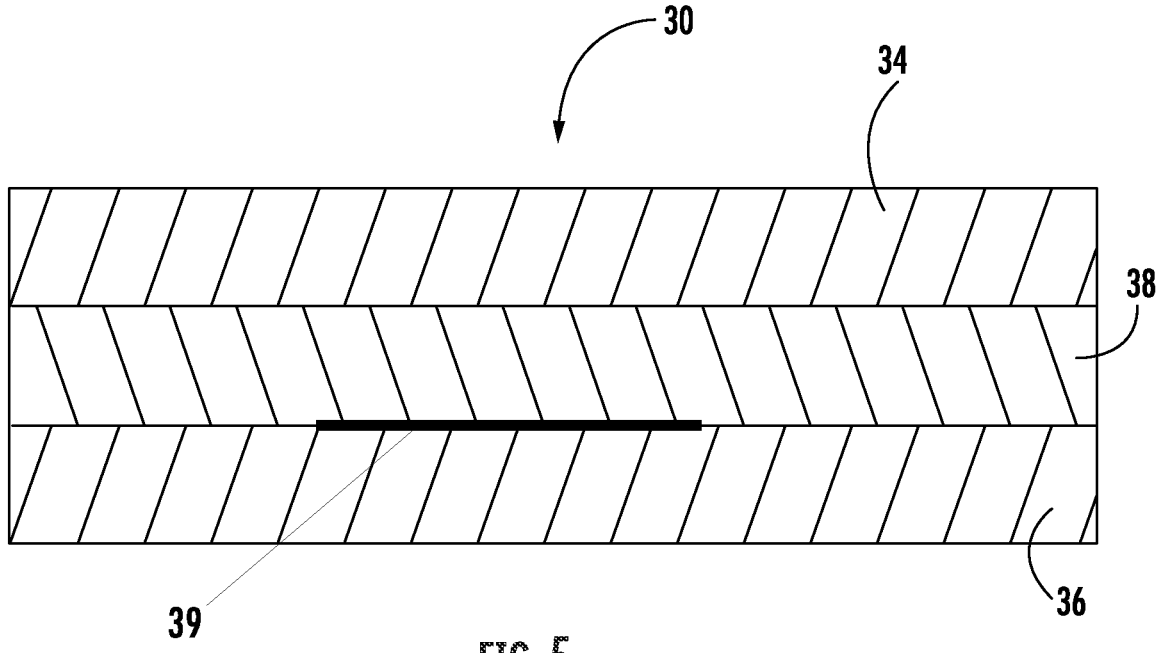
FIG. 5 is a cross section of the label assembly of FIG. 4*a*.
Figure 6A:
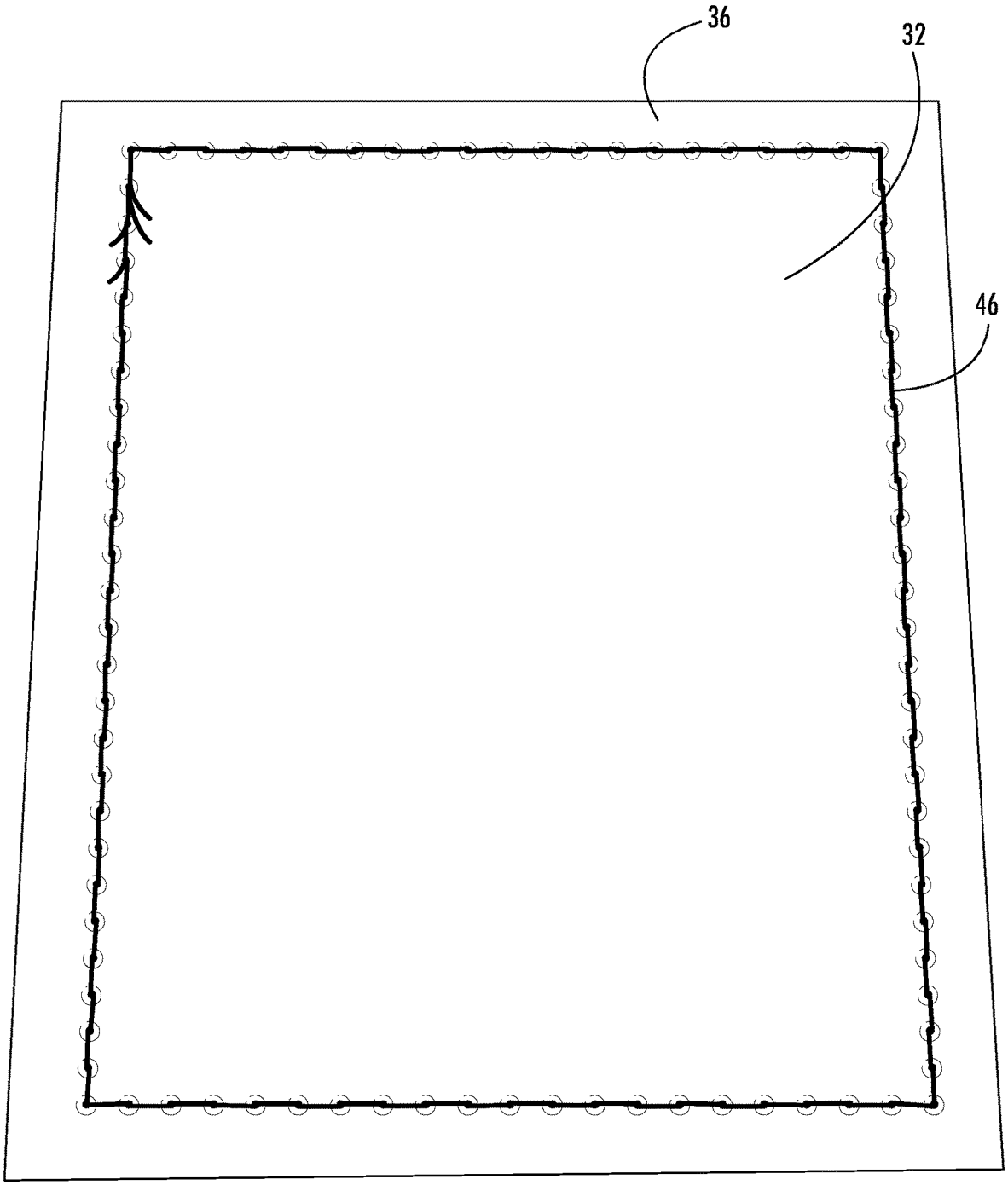
FIG. 6*a* is a back view of the label assembly of FIG. 4*a*.
Figure 6B:
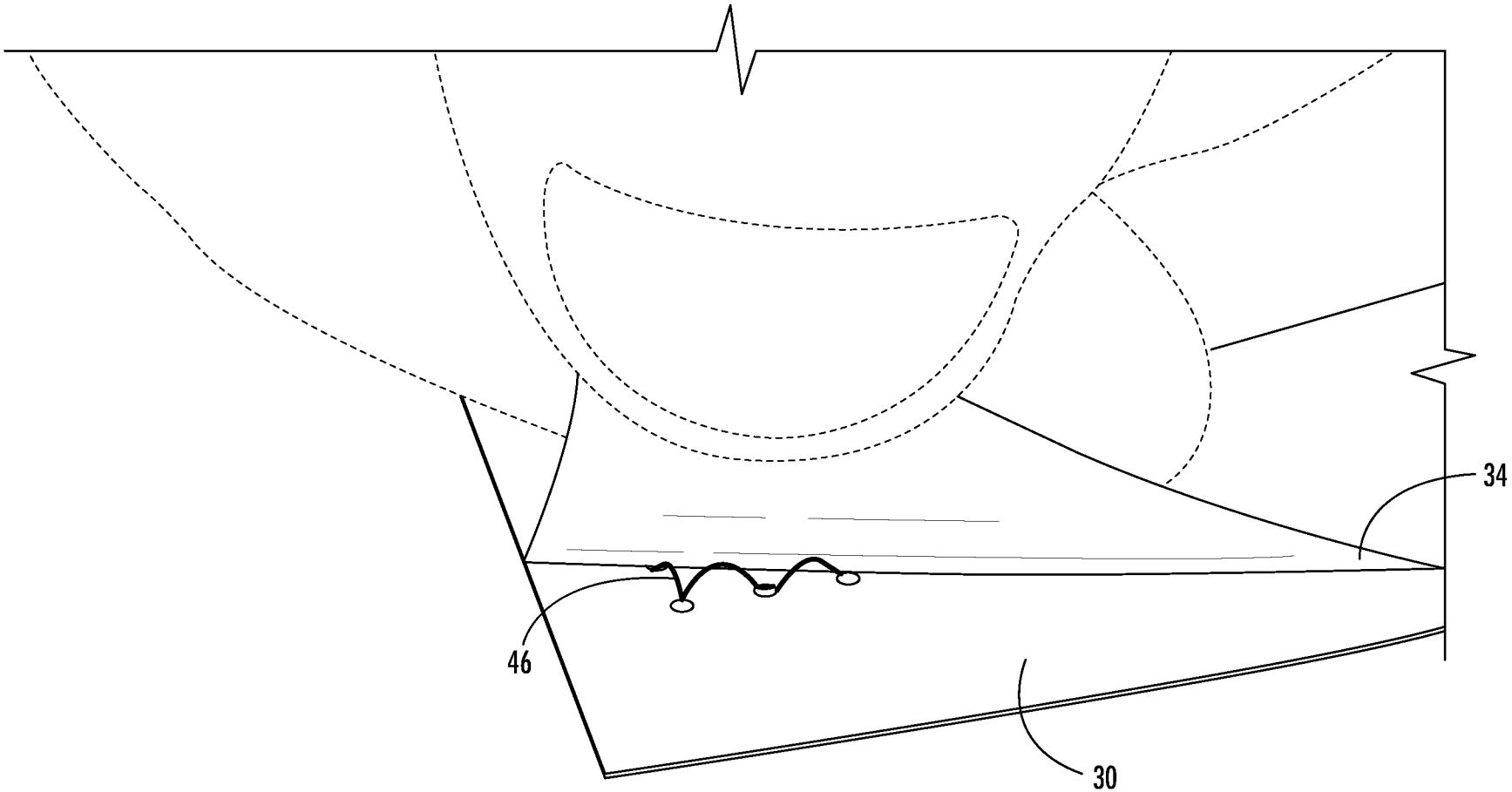
FIG. 6*b* is a front view of the label assembly of FIG. 4*a*, the label assembly having a plurality of layers.

Referring now to the drawings, and more particularly to FIGS. 1-3, shown therein is an exemplary embodiment of a package 10 constructed in accordance with the inventive concepts disclosed herein. In the preferred embodiment, the package 10 incorporates a scratch away surface or message assembly 12. The scratch away surface 12 includes a concealment layer 14 and a color layer 16. The concealment layer 14 is configured to shield the underlying color layer 16 from view. In one embodiment, the concealment layer 14 is black paint adhered to the underlying color layer 16. It should be understood by one of ordinary skill in the art that the concealment layer 14 may be any color of paint or other material used in covering the color layer 16 so long as the color layer 16 is concealed and the concealment layer 14 may be removable from the color layer 16 as described herein.

In an embodiment, the color layer 16 comprises printed paper. In varying embodiments, the color layer 16 is customizable to display photos, images, colors, or underlying messages. In an embodiment, the adherence takes place by painting on the black paint to the color layer 16 of the scratch away surface 12.

A variety of advantages associated with the incorporation of a concealment layer into embodiments of the invention are described herein. In one context, the concealment layer can allow for a drawing created by removing a portion of the concealment layer to reveal a further message or photo underneath the concealment layer. For instance, such message or photo underneath the concealment layer could exist within the color layer to provide a clue to the contents. In another instance, the concealment layer could be completely removed to reveal a second message, such as a surprise gift message.

The scratch away surface 12 is configured to fit specifically within a gift bag 18. In one embodiment, one external panel of the gift bag of a standard sizing (8 inches by 10 inches) is cut out with a rectangular opening approximately 3.75 inches wide by 4.75 inches tall. The scratch away surface 12 is cut to a corresponding size and placed within the opening in the external panel of the gift bag. The scratch away surface 12 is affixed and incorporated into the gift bag by cutting a hole into the gift bag and then gluing the borders of a scratch away surface 12 to the interior of the gift bag, and then subsequently adhering a protective layer 20 over the scratch away surface 12.

In an embodiment, the protective layer 20 is a peel-away film. The peel-away film is configured to protect the scratch away surface. The peel-away film is particularly customized for use in association with packaging by attaching to the scratch away surface 12 and then subsequently detaching from the surface at perforations 22, as shown in FIG. 3. In an embodiment, the peel-away film 20 comprises glue to adhere to an underlying surface only between the perforations 22 and the edges of the peel-away film 20.

Any of the layers described herein may be secured to a package, gift bag, envelope, wine bottle bag or other item contemplated herein or one another, applied manually or automatically with adhesive or cohesive material, pins, clips, staples, magnets, heat seals, chemical seals, vibratory seals or any other binding or securing materials known in the art. The layers can be attached to the package, or can be initially separate from the package and attached at a later time.

In an embodiment, a stylus 24 is provided. The stylus 24 in various embodiments of the invention is generally shaped like a writing instrument such as a pen or pencil. In various embodiments, the stylus 24 is intended to be held by a user and subsequently used to make contact with the scratch away surface 12 in a manner to allow the user to remove portions of the concealment layer of the scratch away surface 12 in the form of a message 26. In one embodiment, the stylus 24 is comprised of wood with a pen-shaped point at the end intended to make contact with the scratch away surface in a manner designed to scrape away a portion of the concealment layer of the scratch away surface 12. In an embodiment, the stylus 24 comprises bamboo. In one embodiment, the scratch away surface 12 is configured such that it is disposable after a single use.

During the one method of use, a user may create the message 26 on the scratch away surface 12 incorporated into the packaging in accordance with a series of defined steps. First, a user removes the peel-away film 20. The user then uses a writing utensil, such as the stylus 24, to inscribe a message by "writing" on the scratch away surface 12 by scratching off a portion of the concealment layer 14. While inscribing the message 26, the user removes a portion of the concealment layer 14 to depict symbols, letters or photos. Following inscription, the package 10 is thereby prepared with a message 26.

Incorporation of a message 26 into the scratch away surface 12 alters the utility of the package 10. In an instance where the package in an embodiment of the invention comprises a gift bag, the incorporation of the scratch away surface 12 improves the ease of surrounding an object with packaging without the need for wrapping, while simultaneously allowing for personalization to allow for the gift bag to be tailored to a specified recipient. The incorporation of the scratch away surface 12 into a package further obviates the need to include a separate name card or label as a separate attachment.

Referring now to FIGS. 4*a*-6*b*, another embodiment of a message assembly 30 is shown constructed in accordance with the present disclosure. The message assembly 30 is similar to the message assembly 12, except as described herein. The message assembly 30 includes a backing layer 32 and a protective layer 34. The backing layer 32 is provided with a background or color layer 36 and a scratch off layer 38. The background layer 36 is similar to the color layer 16 and may be any variety of colors, designs, messages 39 of the like. The scratch off layer 38 is similar to the concealment layer 14 and conceals the background layer 36. In one embodiment, the scratch off layer 38 is black paint, however, any color of paint or opaque like material may be utilized.

The protective layer 34 is positioned over the backing layer 32 to protect the scratch off layer 38 from being removed prematurely. The protective layer 34 is shown herein constructed from a plastic material having a peel away window 40. However, it should be understood by one of ordinary skill in the art that any material may be utilized and configured in various ways, so long as the material covers and protects the scratch off layer 38 and is removable from the scratch off layer 38. An adhesive material such as double sided tape 42 is applied to a portion of one side 44 of the protective layer 34. The double sided tape 42 is utilized for connecting the message assembly 30 to the inside of a bag. It will be understood that any adhesive material or other material known for connecting one object to another may be utilized.

In one embodiment, the backing layer 32 and the protective layer 34 are stitched together with thread 46. It will be understood that the backing layer 32 and the protective layer 34 may be connected in any of a variety of ways and using a variety of materials known for connecting one object to another.

Figure 7A:
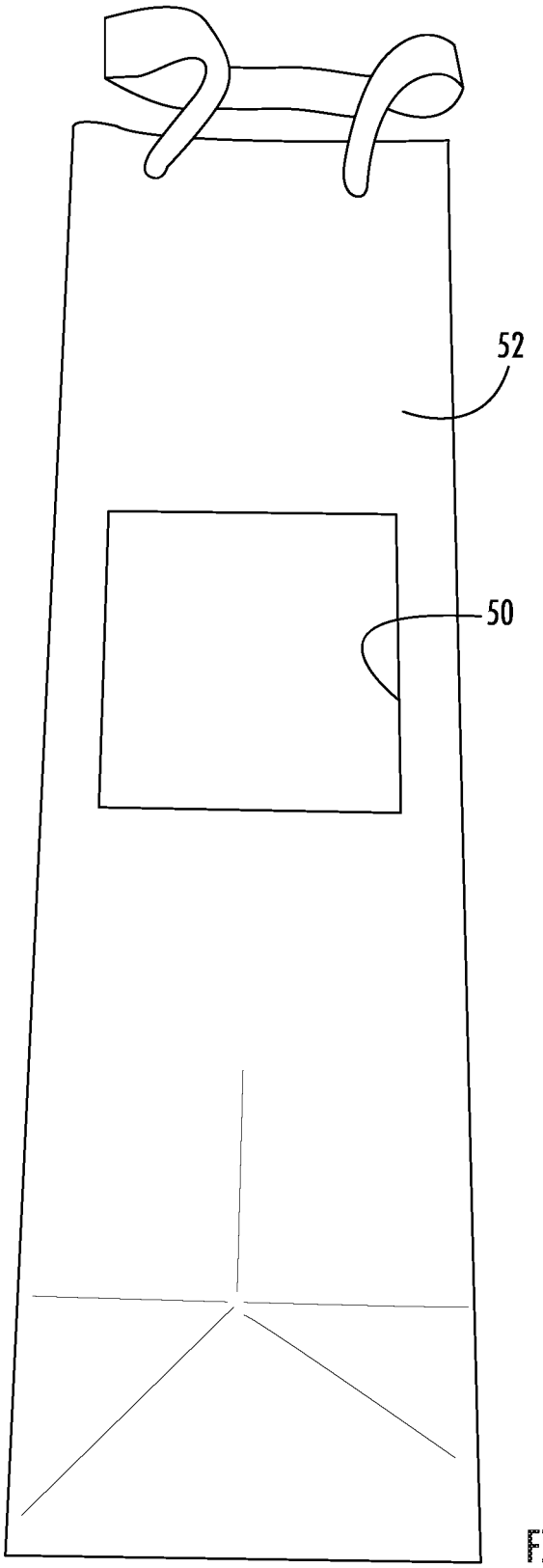
FIG. 7*a* is a perspective view of the label assembly of FIG. 4*a* and a wine bottle bag having a side opening.
Figure 7B:
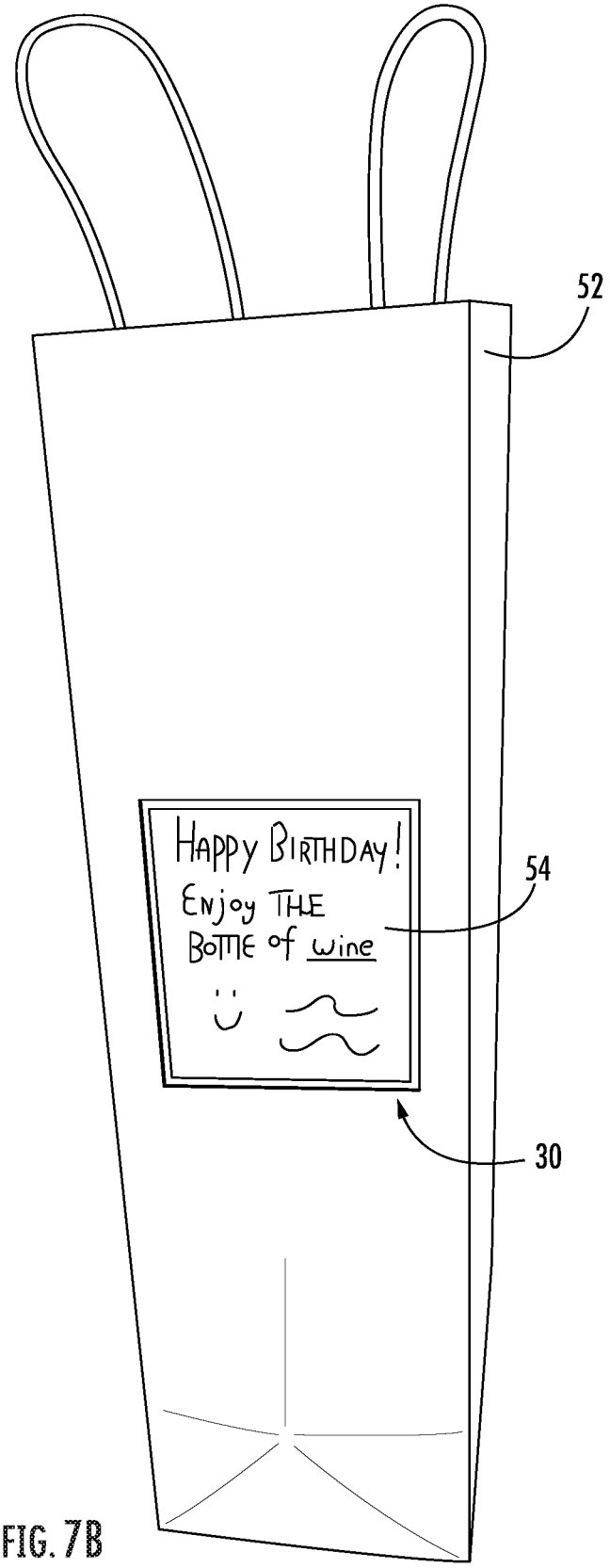
FIG. 7*b* is a perspective view of the label assembly positioned in the side opening of the wine bottle bag of FIG. 7*a*, the label assembly having a customized message.

Referring now to FIGS. 7*a*-7*b*, in use, a cutout opening 50 is made in a package 52, such as a wine bottle bag. The message assembly 30 is positioned inside the package 52 about the opening 50. The message assembly 30 is attached to the inside of the package 52 by utilizing the double sided tape 42. The peel away window 40 is removed from the protective layer 34 thus exposing the scratch off layer 38. An individual uses the stylus 24 or some other instrument to customize a message 54 by removing a portion of the scratch off layer 38. Though a wine bottle bag is described herein in use with the message assembly 30, it will be understood by one of ordinary skill in the art that any type or configuration of bag, envelope, box, or any package like object used for transferring or delivering a good, object, etc. may be utilized in combination with the message assembly 30.

From the above description, it is clear that the inventive concept(s) disclosed herein is well adapted to carry out the objects and to attain the advantages mentioned herein as well as those inherent in the inventive concept disclosed herein. While exemplary embodiments of the inventive concept disclosed herein have been described for purposes of this disclosure, it will be understood that numerous changes may be made which will readily suggest themselves to those skilled in the art and which are accomplished without departing from the scope of the inventive concept disclosed herein and defined by the appended claims.

What is claimed is:

1. A message assembly attachable to a package, comprising:

a base layer having a color layer and a concealment layer wherein a portion of the color layer is attachable to the package; and a protective layer positioned over a portion of the concealment layer, the protective layer removably attachable to the base layer wherein the protective layer is connected to the color layer of the base layer with stitching.

2. The message assembly of claim 1 wherein the concealment layer is a scratch off paint.

3. The message assembly of claim 1 wherein the color layer is a different color than the concealment layer.

4. The message assembly of claim 1 wherein the color layer is a message.

5. The message assembly of claim 1 wherein the color layer is a design pattern.

6. The message assembly of claim 1 wherein the protective layers is plastic.

7. The message assembly of claim 1 wherein the protective layer has a peel away window.

8. The message assembly of claim 1 wherein the protective layer completely covers the concealment layer.

9. A message package, comprising:

a package having an opening in a side of the package; and a message assembly, comprising:

a base layer having a color layer and a concealment layer wherein a portion of the color layer is attachable to the package; and a protective layer positioned over a portion of the concealment layer, the protective layer removably attachable to the base layer wherein the message assembly is positioned about the opening in the side of the package and attached to the package.

10. The message package of claim 9 wherein the concealment layer is a scratch off paint.

11. The message package of claim 9 wherein the color layer is a different color that the concealment layer.

12. The message package of claim 9 wherein the color layer is a message.

13. The message package of claim 9 wherein the color layer is a design pattern.

14. The message package of claim 9 wherein the protective layers is plastic.

15. The message package of claim 9 wherein the protective layer has a peel away window.

16. The message package of claim 9 wherein the protective layer completely covers the concealment layer.

17. The message package of claim 9 wherein the protective layer is connected to the color layer of the base layer with stitching.

18. A method of creating a message package, comprising the steps of:

providing a package having an opening in a side of the package;

providing a message assembly, comprising:

a base layer having a color layer and a concealment layer wherein a portion of the color layer is attachable to the package; and a protective layer positioned over a portion of the concealment layer, the protective layer removably attachable to the base layer;

positioning the message assembly about the opening in the side of the package; and attaching the message assembly to the package.

19. The method of claim 18, further comprising the steps of:

removing the protective layer from the message assembly; and writing a message in the concealment layer of the message assembly.

* * * * *